US008707487B2

(12) United States Patent
Kullman

(10) Patent No.: US 8,707,487 B2
(45) Date of Patent: Apr. 29, 2014

(54) CANE HOLDER

(71) Applicant: F. Marc Kullman, Madisonville, LA (US)

(72) Inventor: F. Marc Kullman, Madisonville, LA (US)

(73) Assignee: Universal World LLC, Madisonville, LA (US)

( * ) Notice: Subject to any disclaimer, the term of this patent is extended or adjusted under 35 U.S.C. 154(b) by 0 days.

(21) Appl. No.: 13/754,711

(22) Filed: Jan. 30, 2013

(65) Prior Publication Data

US 2013/0205498 A1 Aug. 15, 2013

Related U.S. Application Data

(63) Continuation of application No. 29/386,571, filed on Mar. 2, 2011, now Pat. No. Des. 677,960.

(51) Int. Cl.
*A47C 21/00* (2006.01)
*A45B 1/00* (2006.01)

(52) U.S. Cl.
USPC ..... 5/659; 5/503.1; 5/658; 135/66

(58) Field of Classification Search
USPC ..... 5/503.1, 658, 659, 426, 504.1, 662; 135/66
See application file for complete search history.

(56) References Cited

U.S. PATENT DOCUMENTS

| | | | | |
|---|---|---|---|---|
| 4,022,502 | A * | 5/1977 | Smith et al. | 297/411.23 |
| 4,895,330 | A * | 1/1990 | Anstead | 248/229.12 |
| 5,732,914 | A * | 3/1998 | Flinn | 248/201 |
| 5,787,530 | A * | 8/1998 | Brix | 5/662 |
| 6,311,942 | B1 * | 11/2001 | Rotter et al. | 248/316.5 |
| 8,381,333 | B2 * | 2/2013 | Friedman | 5/95 |

* cited by examiner

*Primary Examiner* — Michael Trettel
(74) *Attorney, Agent, or Firm* — Technology Legal Counsel LLC

(57) ABSTRACT

A cane holder comprising one or more horizontal perpendicular plates, optionally one or more horizontal parallel plates, and a pair of support members for holding a cane, wherein the distance between the support members can be adjusted to fit the length of the cane.

5 Claims, 4 Drawing Sheets

CANE HOLDER

RELATED APPLICATIONS

This application claims priority to U.S. Design patent application Ser. No. 29/386,571 filed Mar. 2, 2011, which is hereby incorporated by reference for all purposes.

BACKGROUND OF THE INVENTION

The present invention is directed towards a device for securely and conveniently holding a device such as a cane securely and conveniently horizontally alongside a bed.

In 2000, the total direct cost of all fall injuries for people 65 and older exceeded $19 billion. The financial toll for older adults is expected to increase as the population ages, and may reach $54.9 billion by 2020. For people age 72 and older, the average health care cost of a totaled $19,440, including hospital, nursing home, emergency room and home health care, but not doctors' services.

Falls occur in about one in three individuals age 65 or older every year. More than half of fall injuries occur at home. Elderly people are more likely to fall if they have medical problems that result in the need to get up from bed at night. Likewise, they are more likely to fall if they use a walking aid, such as a cane or walker. Elderly adults are hospitalized for fall-related injuries five times more often than they are for injuries from other causes. One in three who fall using a walker, and one in four who fall using a cane had to be hospitalized.

Falls can easily lead to withdrawal from social activities such as visiting friends and relatives, attending religious services, or taking trips. Mobility problems that may result from a fall can make it more difficult for an elderly person to continue to engage with others. Further, the majority of those who have a fall lose confidence in their ability to move around, and so they tend to isolate themselves. This can make the elderly prone to loneliness and depression, both of which can have a substantial negative impact on their health and quality of life.

For those who make use of a cane, there can be difficulty in locating the cane, particularly at night when in bcd. Such a problem can cause the person to be susceptible to a fall when searching for the cane.

BRIEF SUMMARY OF THE INVENTION

The embodiments described herein provide for a cane holder.

The present invention provides a solution for meeting the safety needs and concerns of elderly citizens who make use of a cane. More particularly, the present invention provides a place for storing the cane when the person has retired to bed at night.

These and other aspects of the disclosed subject matter, as well as additional novel features, will be apparent from the description provided herein. The intent of this summary is not to be a comprehensive description of the claimed subject matter, but rather to provide a short overview of some of the subject matter's functionality. Other systems, methods, features and advantages here provided will become apparent to one with skill in the art upon examination of the following FIGURES and detailed description.

BRIEF DESCRIPTION OF THE DRAWINGS

The novel features believed characteristic of the invention will be set forth in any claims appended hereto or that are filed later. The invention itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF THE INVENTION

Figure 1:
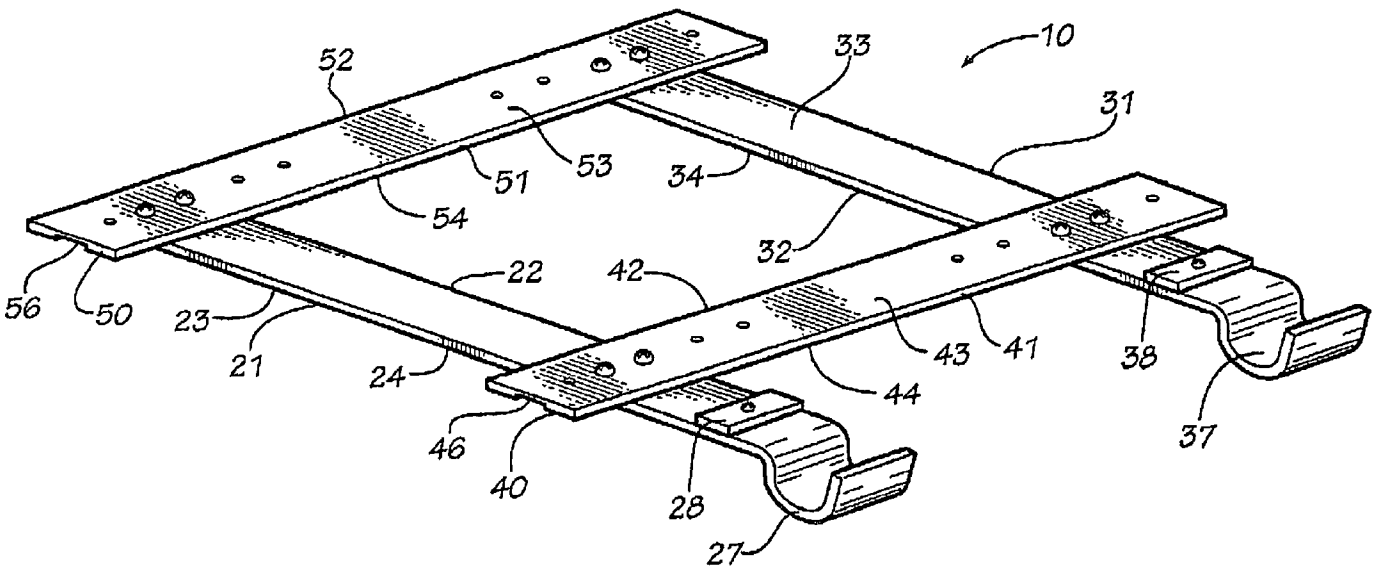
FIG. 1 shows a perspective view of an embodiment of the disclosed cane holder.
Figure 2:
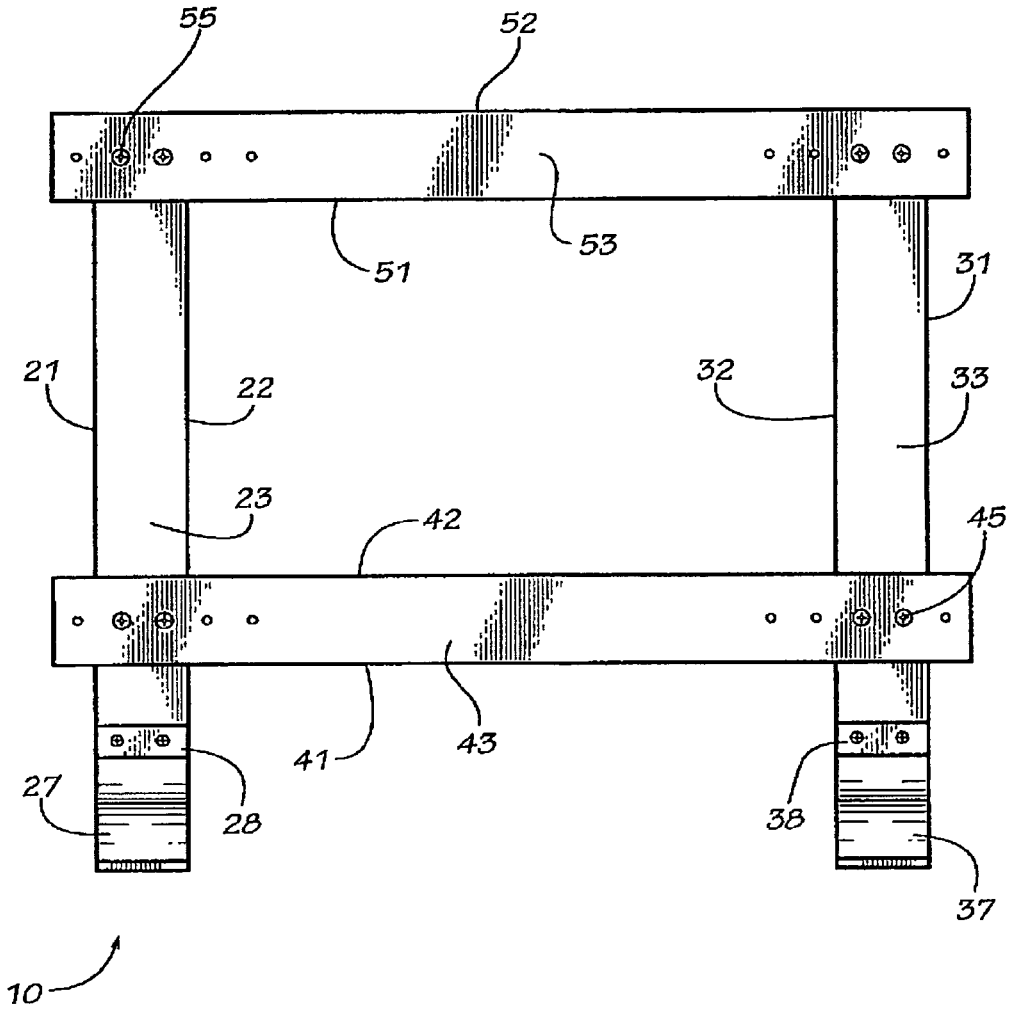
FIG. 2 shows a top elevation view of an embodiment of the disclosed cane holder.
Figure 3:
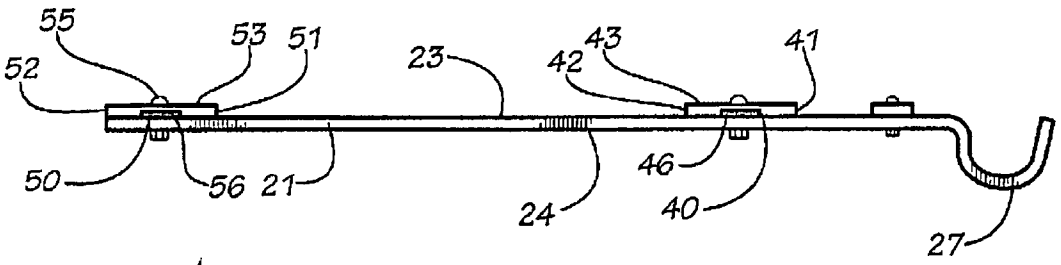
FIG. 3 shows a side elevation view of an embodiment of the disclosed cane holder.
Figure 4:
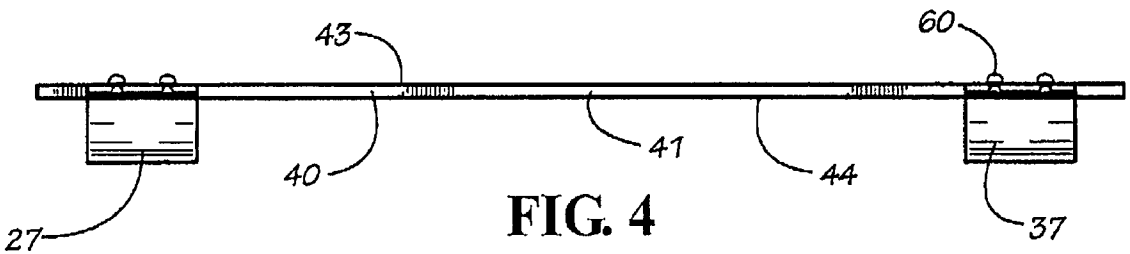
FIG. 4 shows a front perspective view of an embodiment of the disclosed cane holder.
Figure 5:
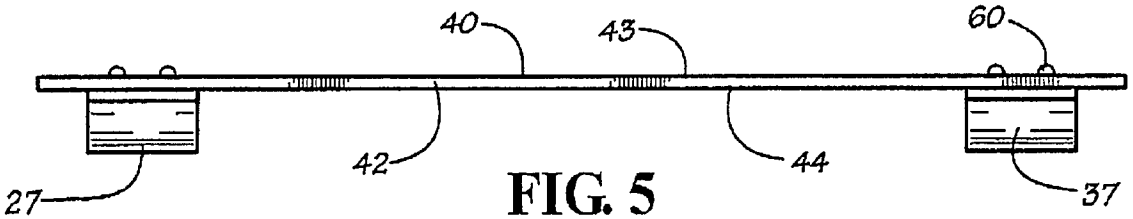
FIG. 5 shows a rear perspective view of an embodiment of the disclosed cane holder.
Figure 6:
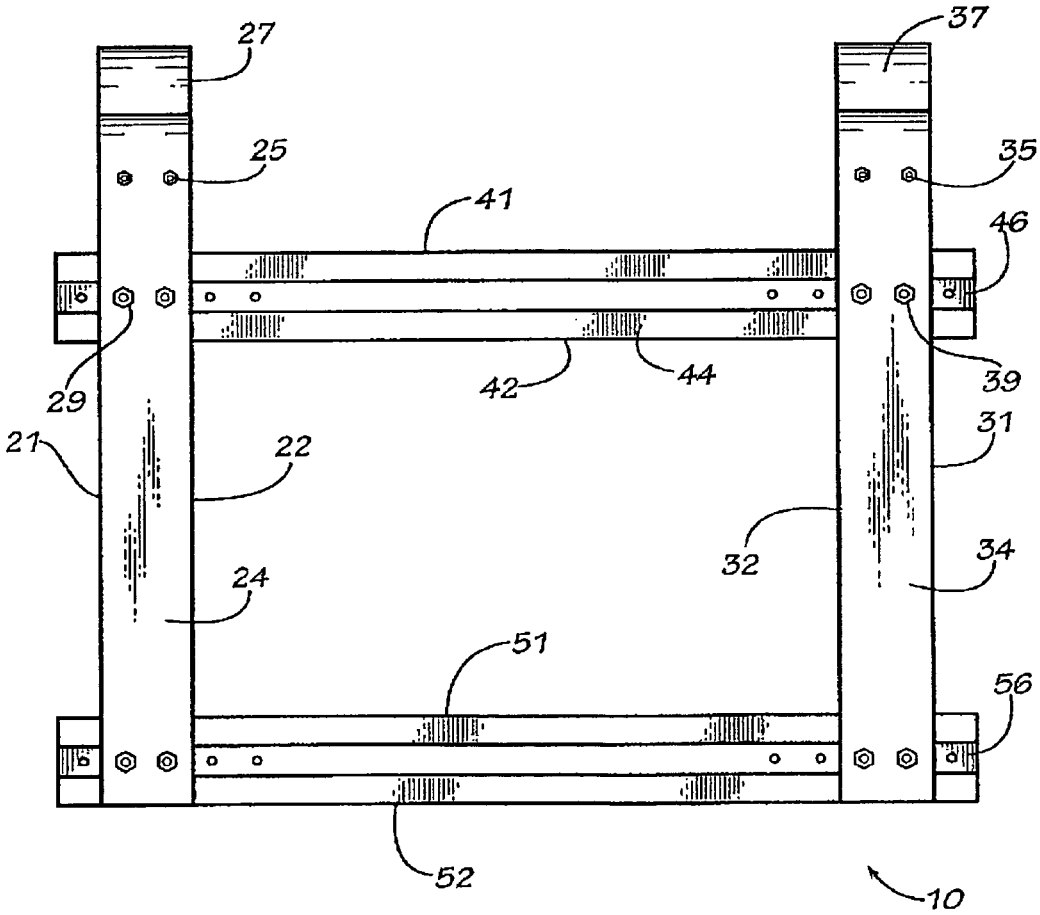
FIG. 6 shows a bottom view of an embodiment of the disclosed cane holder.

The disclosed embodiments describe a cane holder.

In one embodiment, the cane holder 10 is generally planar in design, extending inwardly from the support members 25, 25 to the top or innermost end of the first and second horizontal perpendicular plates 20, 30. These plates are referred to as 'perpendicular' plates 20, for the purpose of describing the invention because, considering the edge of a mattress as extending along an XY axis, the plates 20, 30 are perpendicular to that axis. Likewise, the plates 20, 30 are referred to as 'horizontal' plates 20, 30 because, considering the top of a mattress as a plane, the plates 20, 30 extend horizontal to that plane.

In some embodiments, each horizontal perpendicular plate 20, 30 has an outer edge 21, 31, inner edge 22, 32, upper surface 23, 33, and lower surface 24, 34. Further, the plates 20, have at least one raised portion positioned 28, 38 on the upper surface 23, 33 towards the mattress edge portion of the plates 20, 30. However, it is understood that such a configuration is non-limiting; that is, the one or more raised portions 28, 38 can be positioned, for example, on the lower surface 24, 34 of the plates 20, 30 toward the center of the plate 20, 30 or elsewhere as desired.

In other embodiments, considering the XY axis of the edge of a mattress, a pair of horizontal, parallel plates 40, 50 run 'parallel' to this axis in a plane 'horizontal' to the top plane of a mattress. Each horizontal parallel plate 40, 50 has an outer edge 41,51, inner edge 42, 52, upper surface 43, 53, and lower surface 44, 54. When secured to the horizontal perpendicular plates 20, 30, the combination of the horizontal perpendicular plates 20, 30 and the horizontal parallel plates 40, 50 prevent the support members 27, 37 from shifting when the holder 10 is placed between mattresses, thereby insuring that the cane remains secure when stored on the holder 10. Further, the plates 40, 50 have a recess 46, 56 centrally located on the lower surface 44, 54 extending at least partially along the length of the horizontal parallel plates 40, 50 from both ends.

In an embodiment, centered above the recess 46, 56 are one or more ports 45, 55. The ports 45, 55 are adapted to receive a securing member 60 such as a nut and bolt. The horizontal perpendicular plates 20, 30 further contain one or more ports 25, 35 for also receiving the securing member 60, thereby securing the horizontal perpendicular plates 20, 30 to the horizontal parallel plates 40, 50. The port 25, 35 can have a recess 29, 39 for receiving at least a portion of the securing member 60 (e.g., the nut), thereby providing a locking mechanism. The horizontal parallel plates 20, 30 have multiple ports 25, 35 spaced equidistant from one another from each end of the plates 20, 30. This multitude of ports 25, 35 enables the spacing of the horizontal perpendicular plates 20, 30 to be varied from each other, thereby enabling the distance between the support members 27, 37 to be adjusted as needed based on the length of the cane. In another embodiment, the recesses 25, 35 can be configured to mate with a portion of the horizontal perpendicular plates 20, 30 in a 'snap-on' securing configuration. Further, though the horizontal parallel plates 40, 50 are described such that their lower surface 44, 54 are adjacent to the upper surfaces 22, 32 of the horizontal perpendicular plates 20, 30 when secured together, one skilled in the art would readily recognize that the opposite configuration is also possible, namely, the upper surfaces 43, 53 of the horizontal parallel plates 40, 50 can be adjacent to the lower surfaces 24, 34 of the horizontal perpendicular plates 20, 30 when secured together, with the recesses 46, 56 located on the upper surfaces 43, 53 of the horizontal parallel plates 40, 50.

Because, in some embodiments, the horizontal parallel plates 40, 50 may be raised above (or alternatively, below) the horizontal perpendicular plates 20, 30 when secured together, slippage of the holder between the mattress and box spring is minimized. Still, the holder can be further modified to prevent slippage by, for example, adding a plurality of raised areas 28, 38 along either the horizontal perpendicular plate 20, 30, horizontal parallel plates 40, 50, or both. These raised areas 28, 38 can be located on the upper surfaces 23, 33, 43, 53, lower surfaces 24, 34, 44, 54, or both.

In yet another embodiment, extending outwardly from one end of the horizontal perpendicular plate 20, 30 may be a U-shaped support member 27, 37 for carrying or supporting the cane when the individual is at rest in the best.

When in use, the holder 10 with the horizontal perpendicular plates 20, 30 secured to the horizontal parallel plates 40, 50 may be inserted between a mattress and box spring until the U-shaped support members 27, 37 abuts against the mattress or box spring. The holder 10 is inserted with the upper surfaces 23, 33, 43, 53 adjacent to the mattress and the lower surfaces 24, 34, 44, 54 adjacent to the box spring. The cane can then be placed in the support members 27, 37 such that the handle of the cane is close to a person lying or sitting in bed. The cane holder 10 can be placed between the mattress and box spring in a position where a person in bed can conveniently and confidently access the cane when needed to leave the bed.

In an alternative embodiment, the holder may comprise a substantially rectangular horizontal plate having a linear groove extending substantially along an outer edge of the plate. Support members separate from the plate having a C-shaped portion at the inner side of the U-shaped support member can then be snapped onto the horizontal plate in a locking fashion into the groove. In this manner, the U-shaped support members 27, 37 can then be slid along the groove, thereby spacing the members apart from each other based on the length of the cane.

The holder can be designed from a variety of materials. Because the holder has potential for use in a hospital environment, in an embodiment, the holder is injection molded using a polymeric material suitable for use in a clean or sterile environment. The polymeric material should be sufficiently flexible to bend in use when the weight of a person on the mattress is applied to the holder, yet stiff enough to support the cane. Suitable polymers include polypropylene, polyamides, polycarbonate, polysulfone, styrenics and polyesters. Preferably, the polymeric material is at least a polycarbonate. Polycarbonates are known to have clarity, high strength and impact resistance, good heat resistance, low water absorption and biocompatibility, making them useful in medical devices. In another embodiment, the polymeric material is a combination or blend of various polymers, such as a polycarbonate/acrylonitrile-butadiene-styrene (ABS) blend or a polycarbonate/polyester blend.

Because the holder may be utilized by home consumers; additives can be added to the polymeric material to further differentiate the product. One such additive is color. Color technologies in this regard include chroma-shift, metallic, edge glow and glow-in-the-dark. In an embodiment, at least the support members of the holder contain a light emitting additive, preferably a phosphorescent pigment. By addition of a glow-in-the-dark pigment, an individual can more easily locate the cane at night. Further, phosphorescent pigment comes in a variety of colors, thereby allowing for greater product differentiation.

A further additive for inclusion in the polymeric material is a biocide or antimicrobial additive. Choice of biocide is dependent upon a variety of factors, such as cost of the biocide used, the type of polymeric material it is added to, and the environment that it will be exposed to. Various types of biocides useful in polymeric materials include, for example, silver-based biocides, organic-based biocides such as triclosan, and silane-based biocides. As the holder 1 has healthcare applications, the polymeric material preferably includes a biocide.

In some embodiments, the resin to be used is Polycarbonate. The color is provided by Techmer Polymer Modifiers (Techmer PM) and is identified as PCM6437. This colorant is specially formulated to match the selected polycarbonate resin base.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teaching herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. Cane holder for supporting a cane comprising:

a first horizontal perpendicular plate having an upper surface, a lower surface, an outer edge and an inner edge, wherein the first horizontal perpendicular plate is configured to extend perpendicularly from an edge of a bed toward a center of the bed;

a second horizontal perpendicular plate having an upper surface, a lower surface, an outer edge and an inner edge, wherein the second horizontal perpendicular plate is configured to extend perpendicularly from the edge of the bed toward the center of the bed;

a first horizontal parallel plate having an upper surface, a lower surface, an outer edge and an inner edge, wherein the first horizontal parallel plate is configured such that the outer edge extends parallel to the edge of the bed, and wherein a narrow end of the first horizontal parallel plate is attached to the first horizontal perpendicular plate and the opposite end of the first horizontal parallel plate is attached to the second horizontal perpendicular plate;

a second horizontal parallel plate having an upper surface, a lower surface, an outer edge and an inner edge, wherein the second horizontal parallel plate is configured such that the outer edge extends parallel to the center of the bed, and wherein a narrow end of the second horizontal parallel plate is attached to the first horizontal perpendicular plate and the opposite end of the second horizontal parallel plate is attached to the second horizontal perpendicular plate;

a first support member contiguous with the first horizontal perpendicular plate, wherein the first support member is substantially U-shaped for receiving a portion of a cane, and a second support member contiguous with the second horizontal perpendicular plate, wherein the second support member is substantially U-shaped for receiving a portion of the cane separate from the portion received by the first support member, wherein the first horizontal perpendicular plate has one or more recesses adjacent to the first support member and one or more recesses at the end of the first horizontal perpendicular plate, and the second horizontal perpendicular plate has one or more recesses adjacent to the second support member and one or more recesses at the end of the second horizontal perpendicular plate, and wherein the first and second horizontal parallel plates have one or more securing members at one end of the first and second horizontal parallel plates and one or more securing members at the opposite ends of the parallel plates for securing the first and second horizontal parallel plates to the one or more recesses of the first and second horizontal perpendicular plates, thereby enabling the distance between the first and second horizontal perpendicular plates and the first and second support members to be varied.

2. Cane holder according to claim 1, wherein the cane holder comprises a thermoplastic resin and an antimicrobial agent.

3. Cane holder according to claim 2, wherein the thermoplastic resin is at least a polycarbonate.

4. Cane holder according to claim 1, wherein at least the first and second support members comprise a thermoplastic resin and a light emitting agent.

5. Cane holder according to claim 4, wherein the light emitting agent is a phosphorescent pigment.

* * * * *